US005941050A

United States Patent [19]

Georgetti et al.

[11] Patent Number: 5,941,050

[45] Date of Patent: Aug. 24, 1999

[54] PROTECTING FLAT-ROLLED SHEET METAL FOR SHIPMENT AND STORAGE

[75] Inventors: Tony Georgetti, McDonald, Pa.; Jerry L. Mullens, Weirton, W. Va.

[73] Assignee: Weirton Steel Corporation, Weirton, W. Va.

[21] Appl. No.: 08/890,796

[22] Filed: Jul. 11, 1997

Related U.S. Application Data

[60] Provisional application No. 60/021,249, Jul. 12, 1996.

[51] Int. Cl.[6] ..... B65B 53/00; B65B 25/24; B65B 27/06

[52] U.S. Cl. ..... 53/399; 53/401; 53/409; 53/441; 53/556; 53/588; 53/111 R

[58] Field of Search ..... 53/399, 401, 409, 53/441, 556, 588, 204, 210, 465, 462, 111 R, 111 RC; 206/597

[56] References Cited

U.S. PATENT DOCUMENTS

| | | | |
|---|---|---|---|
| 3,857,486 | 12/1974 | Klebanoff | 53/399 X |
| 4,691,497 | 9/1987 | Lancaster | 53/399 |
| 4,760,915 | 8/1988 | Boets et al. | 206/597 X |
| 5,107,657 | 4/1992 | Diehl et al. | 53/588 X |
| 5,216,871 | 6/1993 | Hannen | 53/588 X |
| 5,463,843 | 11/1995 | Sharp | 53/399 |
| 5,535,572 | 7/1996 | Morantz et al. | 53/588 X |

FOREIGN PATENT DOCUMENTS

| | | | |
|---|---|---|---|
| 517149 | 12/1992 | European Pat. Off. | 53/204 |
| 4327112 | 11/1992 | Japan | 53/409 |

*Primary Examiner*—Linda Johnson
*Attorney, Agent, or Firm*—Shanley and Baker

[57] ABSTRACT

Single station apparatus and processing procedures for packaging production-tonnage coils of flat-rolled sheet metal so as to provide protection from (i) packaged atmosphere, (ii) ambient atmosphere, and (iii) changing ambient atmospheric conditions. Such coil is positioned centrally of such single station apparatus for integrated polymeric stretch-film encapsulation of such wound coil and for securing such coil to a pallet. A centrally-located support of such structure enables pivotal circumscribing movement of a power-driven source of polymeric stretch-film with provisions for control of stretch-film tension. A pallet-mounted sheet metal coil, with its central axis vertically-oriented and with bottom and top planar surfaces protected, is circumferentially wound free of any requirement for movement of pallet or coil so as to encapsulate such coil, in effect, providing hermetic sealing of the coil. And the encapsulated coil is affixed to such pallet by continuous-length polymeric stretch-film wrapping. Coil encapsulating and securing of the coil to the pallet are carried out by integrated processing and by integrated apparatus. A rectangular configuration pallet platform surface requires no central opening for metal strand banding to secure the coil to the pallet, resulting in safer and more efficient palletizing of a coil and release from the pallet.

7 Claims, 5 Drawing Sheets

PROTECTING FLAT-ROLLED SHEET METAL FOR SHIPMENT AND STORAGE

RELATED APPLICATION

This application claims the benefit of U.S. Provisional Patent Application filed Jul. 12, 1996, and assigned Ser. No. 60/021,249.

INTRODUCTION

This invention relates to protective packaging of commercially-produced tonnage quantities of flat-rolled sheet metal. In its more specific aspects, this invention is concerned with packaging such tonnage quantities of flat-rolled sheet metal while achieving sheet metal surface protection from atmosphere for both internal and external surfaces, integrated coil encapsulating and palletizing with minimized packaging and coil anchoring steps at a single station, free of any requirement to move coil or pallet.

In a specific embodiment for describing the invention, commercially-produced flat-rolled sheet metal is wound into continuous-strip coils of selected tonnage, for example, about five to twenty-five tons, or greater, per coil.

BACKGROUND

Packaging such large tonnage sheet metal coils for storage or shipment has been both labor and time intensive, and has generally required procedures carried out separately at several distinct stations.

In the past, such coils have also been subject to damage by narrow-width metal strand used for affixing a coil to a pallet. In addition, use of such metal strand, both during securing and releasing a coil from a pallet, presented safety hazards to personnel and required special measures and equipment to help guard against injury.

SUMMARY OF THE INVENTION

The present invention provides for more effective protection of flat-rolled sheet metal surfaces than previously available, as well as providing for more efficient integrated packaging with a pallet at a single station. Any prior requirement for metal strand to secure coils of flat-rolled sheet metal to pallets has been eliminated.

Polymeric stretch-film wrapping apparatus and procedures eliminate any requirement for relative movement of heavyweight flat-rolled sheet metal or pallet for coil packaging purposes, or for affixing a coil to a pallet with the centrally-located axis of the coil vertically-oriented. Protection components for substantially-planar bottom and top-surfaces provide for substantially hermetic sealing of the sheet metal coil and assure surface protection of the sheet metal from packaged atmosphere, from ambient atmosphere, and from changing ambient conditions.

The above and other contributions and advantages of the invention are described in more detail with reference to the accompanying drawings.

DETAILED DESCRIPTION OF THE INVENTION

In sheet metal coil wrapping and packaging practice of the invention, a rigid pallet is provided with access for forklift prongs to enable lifting and transport of sheet metal free of sheet metal contact with the forklift prongs. In winding a sheet metal coil, continuous strip is wound about a radially expansible and collapsible mandrel which provides a central opening for handling and placement on a pallet.

In the past, flat narrow-width metal strands have been used for securing a coil to a pallet; such metal strands extended through such central opening of a coil and centralized opening in a pallet platform. Eliminating securing of a coil to a pallet by metal strand enables presentation of a continuous-surface pallet support; also, eliminating a requirement for a centralized pallet opening contributes to the desired objectives of the invention.

The present invention discloses polymeric stretch-film wrapping procedures to achieve both sheet metal protection and anchoring of such sheet metal coil to a pallet. Stretch-film wrapping patterns and procedures utilize continuous-length polymeric film. In the integrated packaging procedures, steps for sheet metal protection (i) from packaged moisture, (ii) from contaminated ambient atmosphere, and (iii) from changing atmospheric conditions are carried out initially, before integrated palletizing. Circumferential coil wrapping, in combination with lap edge protection of the lap edge surfaces of a coil, provide for substantially hermetic sealing of the sheet metal coil. However, clarity of description of procedures for fixing a coil to a pallet will be described initially.

Figure 1:
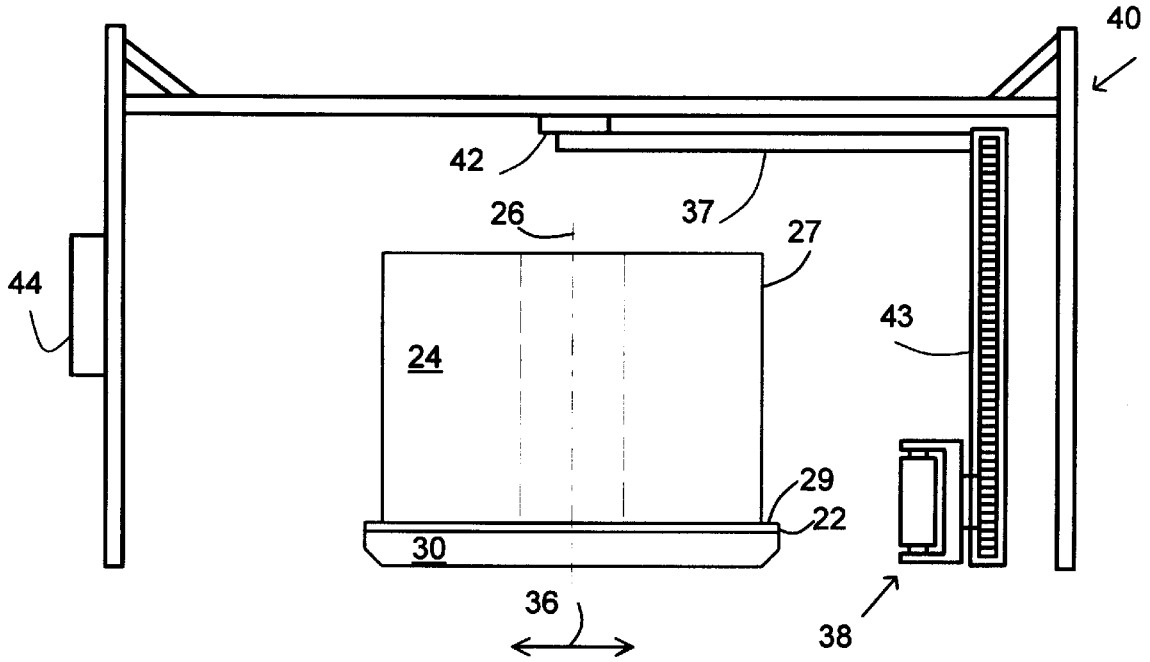
FIG. 1 is a side elevational general arrangement view of apparatus for describing single station sealed wrapping of coiled flat-rolled sheet metal and integrated palletizing of the invention.
Figure 2:
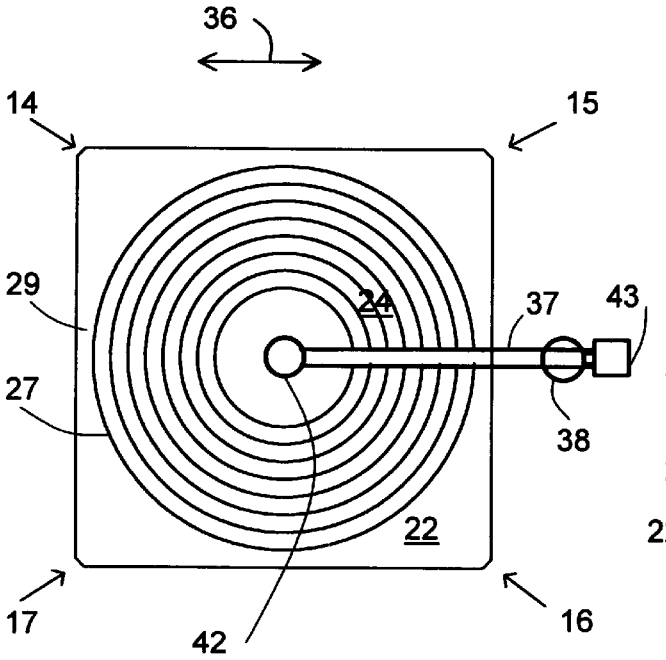
FIG. 2 is a schematic top plan partial view for further describing such overhead support arrangement of FIG. 1.
Figure 3:
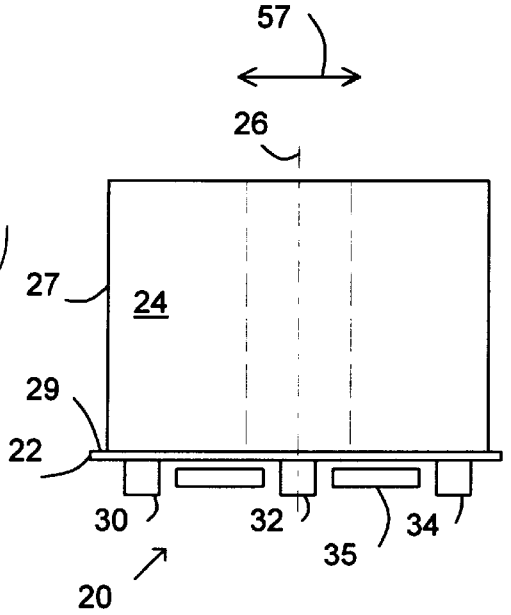
FIG. 3 is a front elevational view of such coil and pallet of FIG. 1 for describing directional-component aspects during coil wrapping of the invention.

Orientations for cylindrical configuration coil and a rectangular configuration pallet are illustrated in FIGS. 1–3. The relationship of pallet corners 14, 15, 16, 17 in a plan view of a square configuration pallet platform are depicted in FIG. 2. Pallet 20 (FIG. 3) presents a support surface platform 22 which is substantially planar. Preferably, platform 22 presents a substantially solid surface free of openings previously relied on for securing tonnage flat-rolled sheet metal to a pallet utilizing narrow-width metal strands. Pallet 20 and platform 22 are selected to have sufficient strength to withstand the weight of coil 24 (for example, about five to about twenty-five tons); such coil is positioned with winding axis 26 (FIGS. 1, 3) vertically-oriented.

A pallet and pallet platform of generally rectangular configuration are preferred for finished product storage, retrieval and transport. Pallet platform corners 14, 15, 16, 17, present a beveled angled configuration, as shown, which is provided for the stretch-film wrapping embodiments of the invention shown in FIGS. 4–10. Stretch-film wrapping, in combination with the rectangular configuration, are relied on for offsetting force tending to move a coil from a pallet platform, for example, over a front or side edge of a platform during lifting or transport.

Cross-sectional dimensions of a pallet platform are selected to exceed coil diameter, as indicated by FIG. 2. In addition to anchoring a coil against relative movement, the larger platform area, with respect to the cross-sectional (transverse to central axis 26) area of coil 24, as indicated at 29 in FIG. 2, helps to protect peripheral cylindrical surface 27 of coil 24 during coil handling, storage and shipping.

Platform 22 is elevated from ground support by pallet structural members, such as 30, 32, 34, as best seen in FIG. 3. Dependent on coil tonnages, structural members, such as 30, 32, 34, are selected to support warehouse stacking of about three to five palletized packs. Spacing between support members 30, 32 and between 32, 34 facilitates entry of forklift prongs, shown schematically at 35 in FIG. 3.

A wound coil of flat-rolled sheet metal is substantially centered with relation to pallet 20 (FIG. 3) and platform 22 (FIG. 2); such a coil is protectively separated from the surface of platform 22 by bottom-surface protection components, including corrosion prevention elements which are shown and described in more detail in relation to later figures. The invention enables but, because of such bottom-surface protection components, does not require use of a solid surface platform; that is, open access areas in the surface of such platform are not required for metal strands which were previously relied on for central-opening banding of a coil to a pallet.

Prior to commencing stretch-film wrapping coil-encapsulating procedures, a final wound sheet metal lap of a coil is preferably held in coiled position by tape or other means.

Continuous-length polymeric film of predetermined tensile strength, waterproofing, and other characteristics is utilized for both encapsulating the sheet metal and securing coil 24 in place on platform 22 of pallet 20. A wrapping pattern is provided to restrain and withstand substantially-horizontal acting forces (which are analyzed as part of the invention) of a coil with respect to its placement on a pallet. Other steps of an integrated procedure; that is, for encapsulating and protecting coiled sheet metal surfaces during transport and storage, have been separated for later description and for clearer presentation in the drawings of stretch-wrap coil anchoring procedures and features of the invention.

As analyzed, forces tending to vertically lift a heavy coil from a pallet are largely offset by the weight of the coil such that significantly less vertically-oriented restraint is required for coil anchoring than horizontally-oriented restraint. And, horizontally-oriented forces tending to move a heavy coil with respect to its pallet and platform tend to be maximized in a direction parallel to the direction of entry of forklift prongs (such as 35 of FIG. 3); that is, a tilted orientation, in order to cradle a forklifted load, requires significant restraint to prevent horizontally-oriented movement of a coil.

Relying on the rectangular configuration of pallet and platform, offsetting directional restraints against movement of a coil can be readily concentrated in a direction parallel to the forklift bars (such as 35, FIG. 3) and, also, can be readily concentrated perpendicularly transverse thereto, as indicated by dual-direction arrow 36 in FIG. 2.

However, substantially-horizontal forces around a full three-hundred sixty degrees of coil perimeter, which can be encountered during transport, are also considered. The possibility of horizontally-oriented forces with directional components at other locations about the full circumference of a coil, for example during road transport, are compensated for in carrying out stretch-film wrapping procedures of the invention for anchoring a coil to a pallet and its platform.

Stretch-film wrapping patterns relying on use of a rectangular configuration pallet and platform are separated into differing directional component phases. And, by combination with other coil protection steps, coil protection against surface contamination is integrated with anchoring procedures. Movement of a pallet-mounted coil during any of those procedures is eliminated. Mobile power-driven equipment is used for controlling supply and tensioning of stretch-film for both coil protection and coil anchoring procedures; and, a single station integrates both sheet metal protection and coil anchoring procedures of the invention. Film handling apparatus, as provided, enables selective film control (a) to maintain a desired orientation of film width in relation to the sheet metal coil and the pallet or its platform, (b) to vertically move the film wrapping source, and its film tensioning mechanism, with respect to dimensions of the coil (with central axis vertically-oriented) and pallet, (c) to circumferentially wrap a coil and portions of a pallet contiguous to its platform corners, and (d) to enable widthwise gathering of stretch-film, at selected locations, in an alternate stretch-film coil anchoring embodiment.

A bottom-protected coil, with its central axis vertically-oriented and its bottom lap edge surface protected, does not require movement after floor roller conveyance of the pallet and coil into a centralized location of an integrated packaging station. In such station, a stretch-film support and wrapping arm 37 (FIGS. 1, 2) provide for circumscribing a coil (24) and pallet (20) with a film source and tensioning means (38) during coil encapsulating and coil anchoring procedures. The film source and tensioning means 38 can move vertically, and revolves symmetrically (in relation to axis 26) about the coil 24 and pallet 20 in order to achieve desired film tensioning to restrain varying horizontally-oriented forces tending to move a coil with respect to a pallet.

A power-driven film source, circumscribing the coil and pallet, helps to establish film tension and desired coil restraint of commercial size and weight sheet metal coils. Framework 40 (FIG. 1) of such film handling and packaging apparatus provides for pivotal support 42. Coil 24 is substantially centrally-located with respect to pivot support 42 which is intersected by an extension of coil axis 26. Power-drive of horizontally-oriented arm 37, which supports stretch-film source and tensioning means 38, provides revolving movement about pallet 22 and coil 24.

Rack 43 enables mechanized vertical movement of such film source and tensioning means 38. During wrapping procedures, circumscribing movement of such film source about the coil and pallet and vertical movement along rack 43 are controlled by programmable control 44. Sheet metal protection and coil anchoring procedures are integrated and tension of the film controlled during each wrapping procedure.

In film wrapping procedures of FIGS. 4–10, the configuration of beveled pallet corners (as shown in FIG. 2) is selected to substantially eliminate initiating puncture of stretch-film during such wrapping to secure a coil to a pallet; and, also, to substantially eliminate film puncturing while restraining coil movement during subsequent handling. Other measures which eliminate the opportunity for such puncturing are considered later in relation to the embodiments of FIGS. 11, 12.

An important procedure selected is to secure a coil to a pallet to restrain relative movement of the coil with a directional component (indicated by dual-direction arrow 57 in FIG. 3) which is in transverse relationship to the entry direction of forklift prongs (such as 35, FIG. 3). A further important wrapping procedure is concerned with securing the coil to the pallet to restrain relative movement of the coil with a directional component (indicated by dual-direction arrow 36 in FIG. 2); that is, in transverse relationship to such entry orientation of the forklift prongs.

Steps in the anchoring procedures in a corner wrapping, stretch-film anchoring embodiment of the invention are described in relation to FIGS. 4–10. Initially, a lengthwise distal end of the selected strength continuous-length stretch-film is secured contiguous to corner 14 (FIG. 4) of pallet platform 22. Such coil anchoring film is stretched in the direction of its length with its width dimension oriented substantially vertically; and is extended from contact with pallet corner 14 to corner 15. The result of multiple wraps of that initial stretch-film pattern is indicated by the wrap configuration lines of increased boldness circumscribing coil 24 and pallet corners 14, 15 of FIG. 4.

Figure 4:
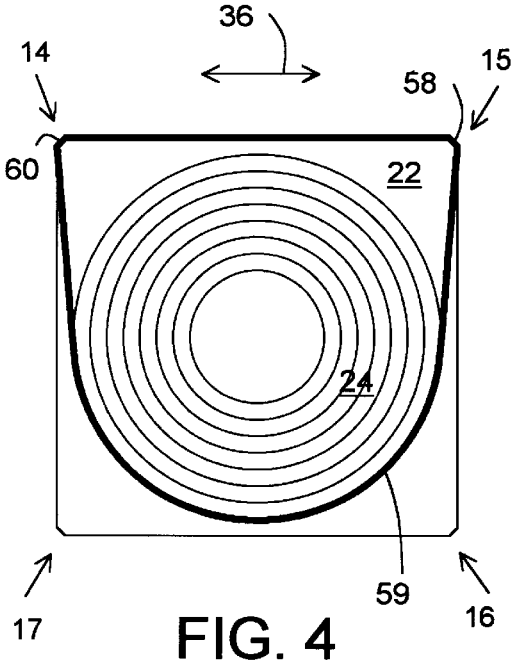
FIGS. 4 and 5 are top plan views of the coil and pallet of FIG. 2 for describing directional-components taken into consideration during coil wrapping procedures of the invention.
Figure 7:
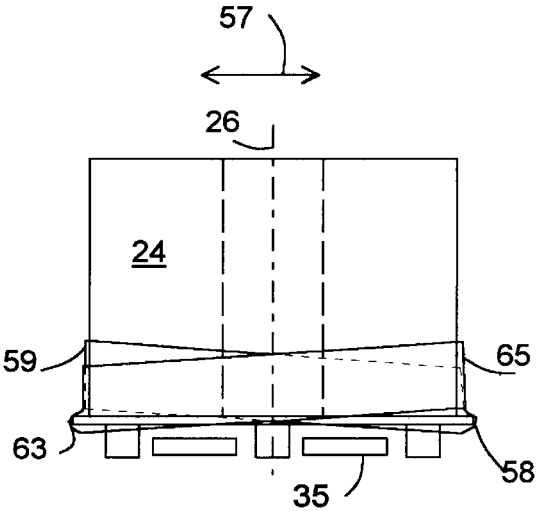
FIG. 7 is a front elevational view of the embodiment of FIGS. 4 and 5.

The stretch-film wrap at the beveled configuration of corner 15 is designated 58 in FIGS. 4 and 7. After stretch-film wrap of corner 15, the film is raised vertically so as to make peripheral contact along the coil cylindrical surface 59, as indicated in FIGS. 4 and 7. The full width of the film (approximately twenty inches in one embodiment) is substantially vertically-oriented during contact along surface 59. The film is stretched in the direction of its length, in contact with the periphery of the coil along such wrap portion 59; the lower widthwise edge of such vertically-oriented film being contiguous to support surface 29 of pallet platform 22.

The film, in such vertical orientation and under tension, maintains such contact with the coil, along a half cylinder peripheral portion of the coil surface, and returns to pallet engagement to contact with beveled configuration 60, in wrapping around corner 14 (FIG. 4). That completes one circumscribing stretch-film wrap contacting a half cylindrical portion of the coil 24 and two pallet corners 14, 15 of FIG. 4. Such film wraps contacting beveled configurations at pallet corners 14 and 15, with coil surface contact at 59, restrain movement of a coil 24 with respect to pallet 22 in one of the directions indicated by dual-direction arrow 57 in FIG. 7.

Figure 5:
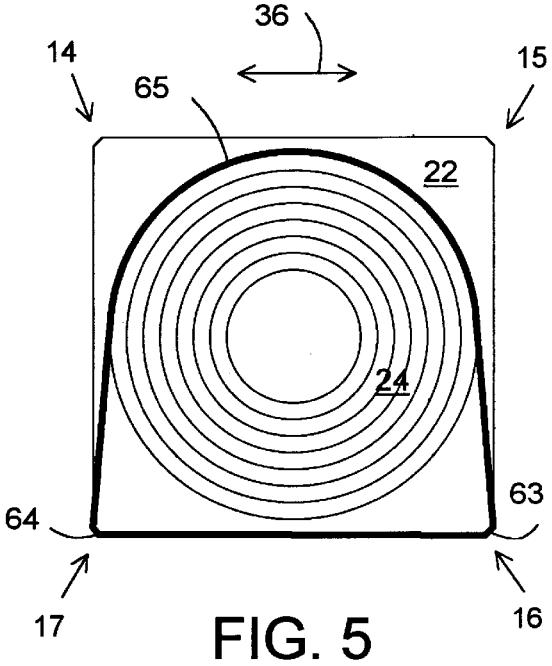
Figure 6:
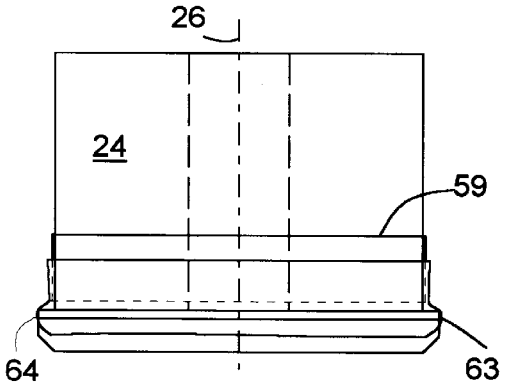
FIG. 6 is a side elevational view of the embodiment of FIGS. 4 and 5.

An initial phase of the embodiment of FIGS. 4–10 further includes stretch-film wrapping around corners 16 and 17 and coil surface contact at 65, as shown in FIG. 5. The stretch-film pallet contact at beveled portions 63, 64 of corners 16, 17, respectively, is shown in FIGS. 5 and 6. A plurality of such stretch-film wraps are indicated by the bold line in FIG. 5.

The stretch-film wrap, described in relation to FIGS. 4, 6 and FIGS. 5, 7, respectively, is repeated for each, with the number of wraps being selected in relation to coil weight. Generally, such stretch-film wraps vary in the range of about three to about eight wraps apiece for each procedure (FIG. 4 and FIG. 5) in order to achieve the restraint desired to offset horizontally-directed forces tending to move a coil.

The number of wraps selected for each wrap procedure of FIG. 4 and FIG. 5, in addition to coil weight, can take into account other factors, such as type of transport. Individual wraps, as described in relation to FIGS. 4 and 5, can be carried out in alternating sequence; or, several or all wraps of each procedure (FIG. 4 or FIG. 5) can be carried out before returning to complete a first selected procedure.

Figure 8:
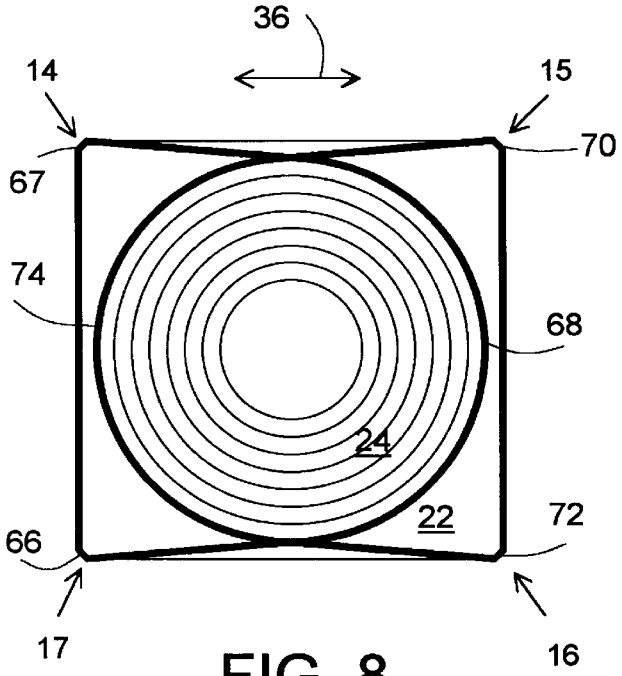
FIG. 8 is a top plan view of a pallet and coil for describing results of coil wrapping of the invention by combining the procedures of FIGS. 4 and 5.

Such two-corner pallet contact and coil surface contact is followed by contact with the remaining two corners and remaining coil surface contact, as described in FIG. 8. That combination eliminates relative movement between a coil and pallet due to forces with directions generally indicated by 36 (FIG. 8) and by 57 (FIG. 9); and, also, in directions intermediate those two perpendicularly transverse directions, covering three-hundred sixty degrees.

Figure 9:
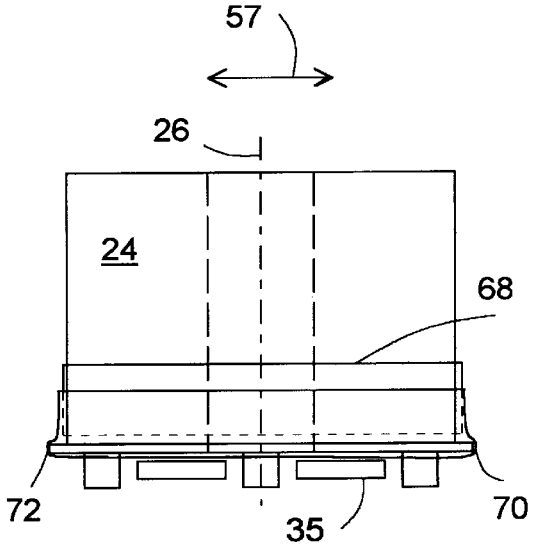
FIG. 9 is a front elevational view for describing the embodiment of FIG. 8.
Figure 10:
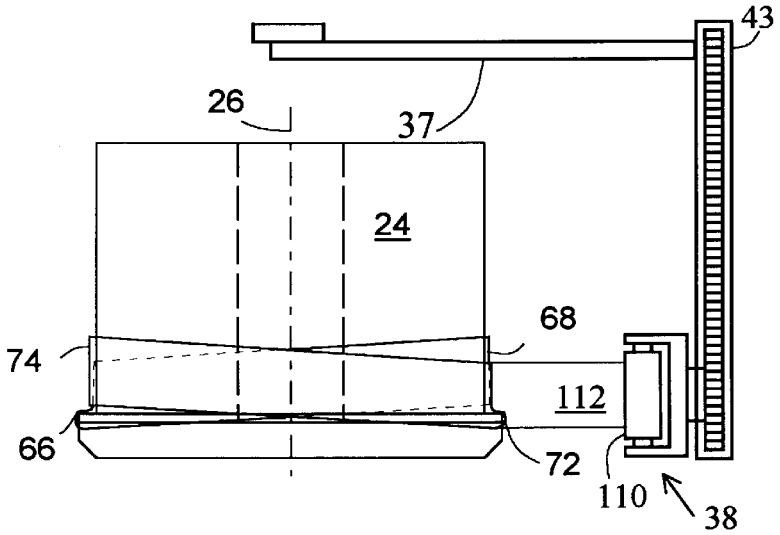
FIG. 10 is a schematic side elevational partial view of the station of FIG. 1 for describing operation of apparatus of the invention to accomplish coil wrapping, as shown in FIG. 8.

Referring to FIGS. 8, 9 and 10, the stretch-film first wrapped around corner 17 beveled configuration 66 is in contact with the pallet in extending toward corner 14. The film is then raised vertically so as to engage the coil surface along 68 (FIGS. 8, 9) with a lower widthwise edge of the film contiguous to the pallet platform (FIG. 9). The film stretches around the coil in contact with substantially a half cylindrical peripheral portion 68 of such coil, returning to corner 17, as shown in FIG. 8; such wrapping restrains longitudinally-directed movement in one direction of those indicated by dual-direction arrow 36.

In a remaining directional wrap procedure, pallet corner 15 is wrapped (bevel configuration 70 in FIGS. 8, 9), followed by wrapping along the pallet toward corner 16 and then around corner 16 (bevel configuration 72 in FIG. 8). The film is then raised vertically and brought into full width engagement with the coil surface along 74 (FIG. 8), with the lower widthwise edge of the film contiguous to the pallet platform (FIGS. 9, 10). Approximately a half cylindrical peripheral portion (74) of the coil is contacted by that portion of the latter wrap. As shown by the bold lines of FIG. 8, coil 24 is secured against movement in directions indicated by the dual-direction arrows 36, 57. Forces tending to cause movement between those two transverse directions are restrained because the full perimeter of the coil is contacted (see bold lines of FIG. 8), such restraint forces covering three-hundred sixty degrees.

Figure 11:
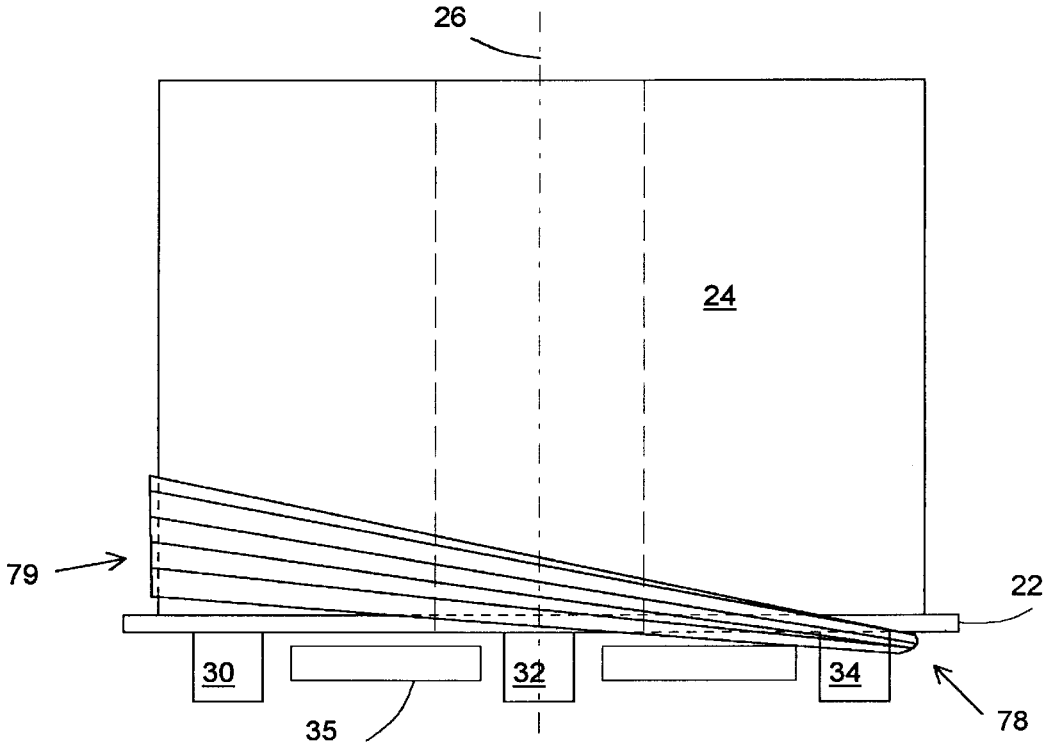
FIG. 11 is a front elevational view for describing another wrapping embodiment for anchoring a coil to a pallet platform in accordance with the invention.

A differing coil anchoring embodiment of the invention is presented in FIG. 11 which eliminates the opportunity for puncture of film at platform corners by eliminating contact of the stretch-film with pallet platform corner configurations.

In place of wrapping around platform corner configurations, when securing coil 24 on pallet 22, the stretch-film is gathered widthwise in approaching a pallet platform corner by bringing lateral side edges of the film together as depicted at 78 in FIG. 11. Such widthwise-gathered film is positioned beneath platform 22 of pallet 20; that is, between a structural support member (such as 34) and the underside of such platform 22, as seen at 78 in FIG. 11. Wrapping sequence, as described above in relation to FIGS. 4–7 and 8–10, are followed. That is, coil surface contact extends over a half cylindrical portion of the coil surface, as shown at 79 in FIG. 11. Such wraps are completed as described earlier in relation to FIG. 8; that is, to secure a coil against relative movement with respect to pallet platform 22, not only in the directions indicated by the dual-direction arrows 36, 57 (depicted in FIGS. 8, 9), but intermediate those major directions around three hundred sixty degrees.

Figure 12:
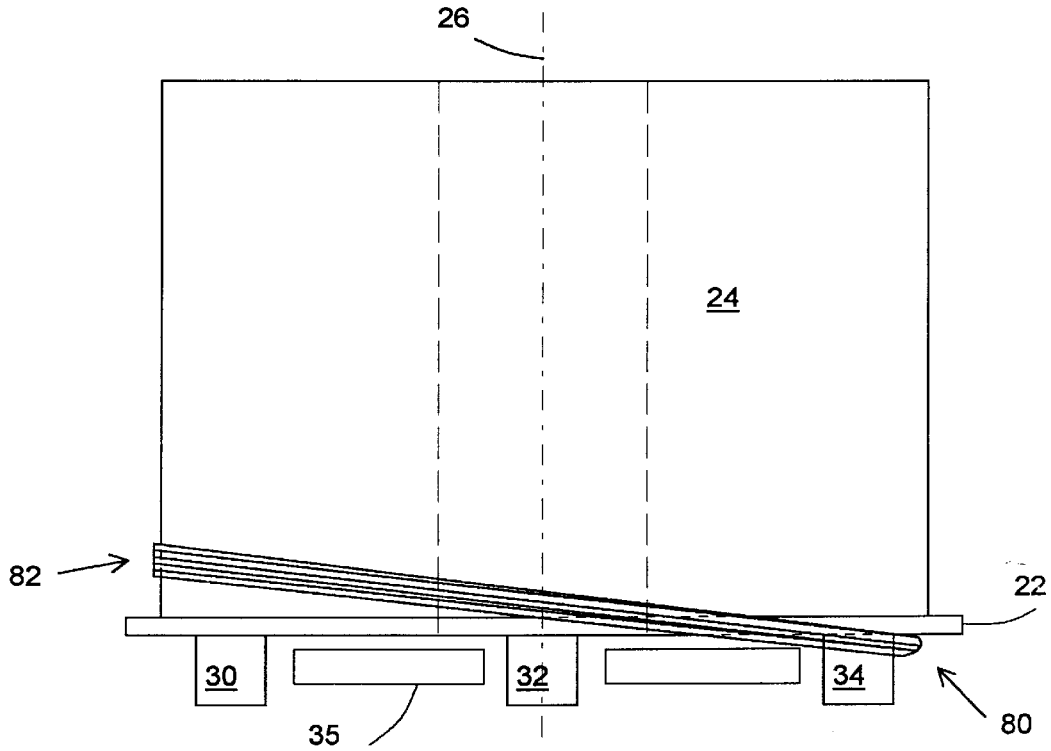
FIG. 12 is a front elevational view for describing a further wrapping embodiment for anchoring a coil to a pallet platform in accordance with the invention.

In a variant of the wrapping embodiment of FIG. 11, the stretch-film is gathered widthwise during the entire wrapping procedure. In FIG. 12, the gathered film engages the pallet at 80 between a support member, such as 34, and the underside of the pallet platform 22; and, coil peripheral surface contact, over half the cylindrical configuration surface of the coil, is also carried out with the film gathered widthwise. Such widthwise gathering of film augments tensile strength of the film and eliminates opportunities for initiating puncturing or undue localized elongation of the film.

Prior to securing a coil to a pallet by stretch-film wrapping procedures described above, a combination of steps is carried out to encapsulate a coil while protecting edges of sheet metal laps, protecting coil configuration surface edges, and chemically protecting flat-rolled sheet metal surfaces during shipment or storage.

In practice, bottom-surface and top-surface protection of a coil, with its central axis vertically-oriented, and corrosion-prevention measures are carried out prior to stretch-film coil encapsulating and coil anchoring procedures. The polymer stretch-film coil wrapping and anchoring procedures, integrated at a single station, complement each other in the substantially hermetic sealing encapsulation features of the invention.

Assembled components for lap edge and coil edge protection for both bottom-surface and top-surface protection of a wound coil (with its central axis vertically-oriented) include an extended area polymer sheet for each such surface, a coil edge protector, a cushioning pad, and Kraft paper with a chemically-treated surface confronting the interior of the sheet metal package. Those bottom-surface components are assembled on a pallet platform before placement of a coil, with its central axis vertically-oriented on such pallet.

The static coefficient of friction of bottom and top-surface components is controlled. Preferably, the cushioning is provided with non-skid surfaces, which can be added to increase friction with a solid or semi-solid pallet platform surface; and, also, to help fix a polymer sheet for bottom-surface and for top-surface encapsulation.

An extended area polymer sheet for each bottom and top-surface is utilized to encapsulate each such surface and protect packaged sheet metal against ambient atmosphere with a moisture-impervious barrier. Such polymer sheet is preferably low density polyethylene (LDPE) having a thickness range of about five to seven mils; and is selected with a surface area which substantially exceeds such respective top and bottom-surface area of the coil (for example, by about twenty to thirty-five percent). A cushioning pad provided for each such surface, is preferably exterior to the polymer encapsulating sheet so as to help protect that sheet at each such surface; a low-slip finish is provided.

The extended-area polymer sheet extends over the coil edge around its full periphery. An externally-located cushioning pad is used to help prevent possible slitting of each such end surface encapsulating polymer sheet. The latter can also serve as a carrier for a chemical treatment for corrosion-protection due to air encapsulated in the packaging. In practice, a Kraft paper liner board is preferably selected with surface dimensions to contact and extend substantially over each such top and bottom-surface area of the coil.

A corrosion-inhibitor to prevent interior corrosion comprises a vapor phase inhibitor (VPI), such as an organic compound with time release properties. Such VPI compound controls any moisture within the encapsulated package so as to inhibit condensation or corrosion. Such VPI materials are generally treated with salts of strong volatile bases and weak volatile acids, such as cyclohexylamine or dicyclohexylamine and carbonic acid or nitrous acid. Dicyclohexylammonium nitrite (DICHAN) is a preferred constituent for such VPI formulations. Such materials are available commercially from Cortec Corporation, St. Paul, Minn. 55110. Such VPI protects the packaged coil against moisture of packaged atmosphere so as to prevent attack of encapsulated sheet metal surfaces during storage and shipment.

Figure 13:
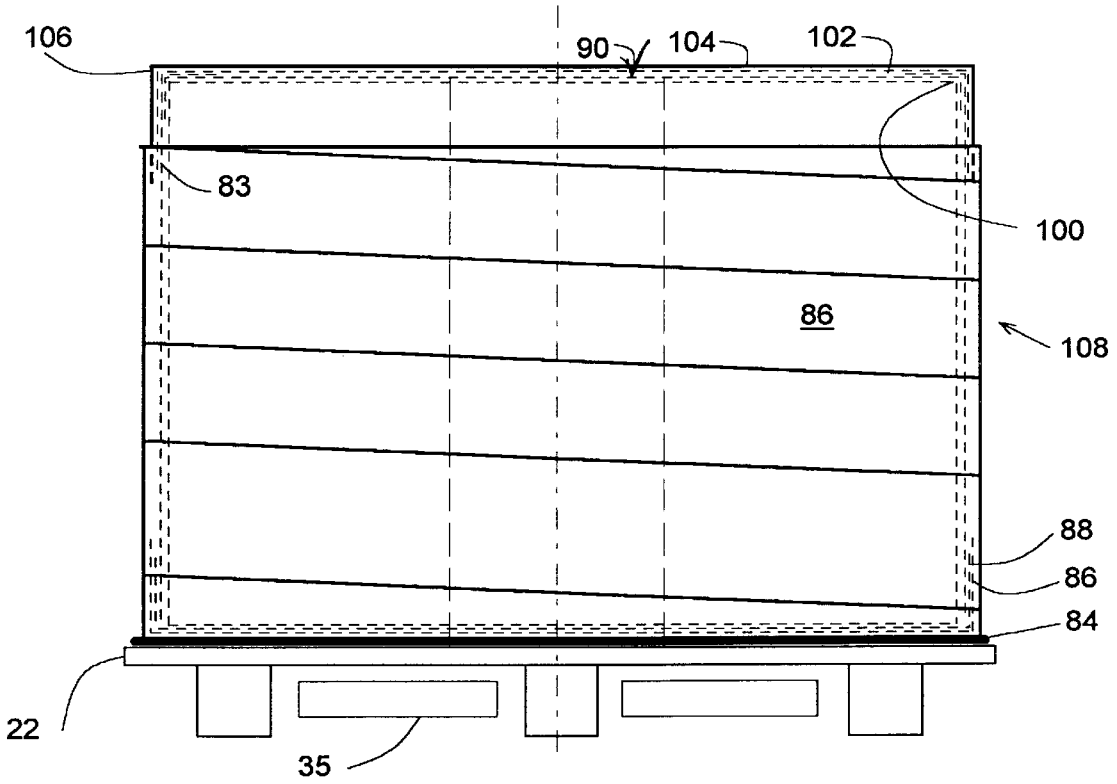
FIG. 13 is a front elevational view for describing a combination of steps of the invention for coil protection.

A bottom-surface cushioning pad is indicated at 84 in FIG. 13. Such pad has a selected thickness and a diameter which slightly exceeds that of the coil outer diameter. It is positioned on the pallet platform surface to provide at least partial cushioning for the bottom polymer sheet 86 which extends to the coil periphery and, also, cushions coil edge protector 88 which extends along at least a portion of the bottom-surface and around the full coil periphery.

Following placement of the coiled sheet metal (FIG. 13) on such bottom-surface components, portions of such bottom polymer sheet and coil edge protector, which extend beyond the coil edge around its periphery, are secured by tape, or otherwise, in vertical orientation against the coil cylindrical peripheral surface prior to start of stretch-film coil encapsulating wrapping.

Top-surface cover means, generally at 90 (FIG. 13), include such plurality of components for coil edge protection, for wound lap edge protection, for presenting VPI for encapsulated air, a top-surface encapsulating polymer sheet, and an external cushioning pad with non-skid surface which is mounted on such surface, in particular, on top-surface when coils are to be stacked.

Figure 14:
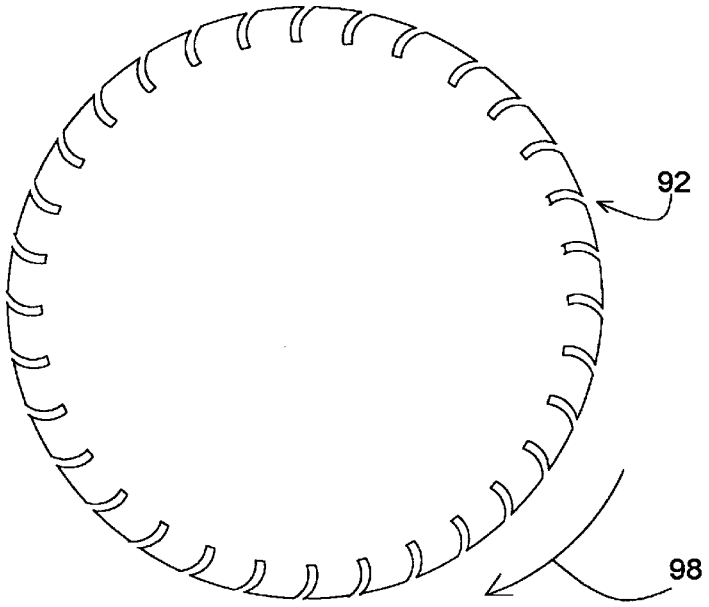
FIG. 14 is a plan view for describing a coil protection component used in the coil protection embodiment of FIG. 13.

VPI-coated Kraft paper confronts the coil interior. A fluted edge pad 92 (FIG. 14) covers the VPI paper and the coil edges. Such fluted edges are defined by arc-like cutout portions which are oriented in a direction which corresponds to the direction for coil periphery encapsulating stretch-film wrapping. Such flutes, after bending over the edge of the coil, help to protect the coil edge from damage, as well as protect additional packaging components from being severed or torn by such coil edge. Bending of such flutes over the coil edge can be augmented by circumscribing scorelines spaced inwardly from the outer circumference of fluted protective edge pad 92; the latter is preferably corrugated board of a weight indicated herein which provides some cushioning effect.

A polymer sheet for top-surface encapsulating extends over the coil edge, around its full periphery. A polymer sheet skirt can be placed circumferentially around the coil at such top-surface edge. The polymer sheet top-surface encapsulating means includes a layer of LDPE (low density polyethylene) and can include a layer of LDPE impregnated with VPI. The top-surface encapsulating polymer sheet means has a diameter in excess of the diameter of the coil; coil periphery overlap by the polymer sheet area is preferably twenty to thirty-five percent greater than the top-surface area and extends over such coil edge. The VPI-impregnated layer, if utilized, confronts the interior of the package.

An LDPE polymer sheet (102 of FIG. 13) having a thickness of about six mils, encapsulates such coil top-surface area and extends over such coil edge; such top-surface polymer sheet preferably includes a low-slip surface treatment on its inner surface.

An external coil edge protection means 104 can also comprise an externally-mounted cushioning pad.

Such top and bottom-surface protection components combine with stretch-film wrapping about the cylindrical peripheral surface of the coil to encapsulate the entire coil. VPI-coated packaging material confronts top and/or bottom-surface wound-lap edges of the sheet metal, and acts throughout the encapsulated coil package.

Polymer stretch-film of continuous length is wrapped, under tension, in the direction of its length to circumferentially encapsulate the entire cylindrical peripheral surface of the coil. Such wrapping is preferably initiated at the top-surface edge of the coil, such as at 106 in FIG. 13, and proceeds in a series of overlapping wraps (indicated at 108 of FIG. 13) extending to the bottom-surface of the coil which is encapsulated, as described earlier; such encapsulating peripheral wrap can extend to include the vertical edge portion of the platform 22.

Such stretch-film wrapping, in combination with top and bottom-surface encapsulation described above, provide stretch-film continuity which, in effect, hermetically seals the coil against ambient atmosphere and changes in ambient conditions; and, the vapor phase inhibitor sealed within the package protects against a staining and corrosive effect of packaged moisture or atmosphere. Then, anchoring of the encapsulated coil to the pallet is initiated as described in relation to FIGS. 4–7 and 8–10; or, by using one of the widthwise gathering embodiments of FIG. 11 or 12.

Table I provides tabulated data for preferred packaging for a coil having an outer diameter of 56" and wound flat-rolled sheet metal having a width of 42".

TABLE I

| | |
|---|---|
| Polymeric Stretch-film | |
| Width | 20 inches |
| Thickness | 0.00165 inches |
| MD* Tensile Strength (D882 11.3)** | 8745 psi |
| MD* Yield Strength (D 882 11.5)** | 10011 psi |
| Pallet | |
| Platform Surface Length & Width Dimensions (Square) | 60" × 60" |
| Bottom Cushioning | |
| Material | Cellulose (shoddy type) |
| Thickness | ½" |
| Density | At least 50 oz/sq yd |
| Configuration | Circular |
| Diameter Dimension | 58" |
| Bottom Encapsulation | |
| Material | LDPE with low-slip additive |
| Thickness | 6 mil |
| Square Perimeter Dimensions | 75" × 75" |
| Bottom Coil Edge Protection | |
| Material | 42# Kraft liner board |
| Circular Configuration Diameter | 65" |
| Coating (for coil internal exposure) | Cortec #246 at 9 grams/sq yd |

TABLE I-continued

| | |
|---|---|
| Internal Top-Surface Coil Edge Protection Material | 175# Test B-Fluted corrugated board |
| Circular Configuration Diameter (including flutes) | 65" |
| Score Line Locations | 54" circle and 56" circle |
| Coating (for internal surface) | VPI (Cortec #246) at 9 grams/sq yd |
| Flutes | ½" width by 5" length arcuate slits at 6" intervals |
| Bottom Encapsulation (Polymer Sheet) | |
| Material | Co-extruded LDPE, impregnated with VPI (Cortec #246) at 9 grams/sq yd on interior surface, non-impregnated LDPE exterior |
| Thickness | 6 to 8 mils |
| Square Perimeter Dimensions | 75" × 75" |
| Top Encapsulation (Polymer Sheet) | |
| Material | LDPE with low-slip additive |
| Thickness | 6 to 8 mils |
| External Top-surface Protection | |
| Cushioning Material | 175# Test B-Fluted Corrugated Board |
| Circular Configuration Diameter | 64" circle |
| Score Line Locations | 56" circle and 54" circle |
| Flutes | ½" width by 5" length arcuate slits at 6" intervals |

*Machine Direction
**ASTM Test

Such stretch-film is available commercially from AEP Industries, Inc., Knoxville, Tenn. 37922, or Deerfield Plastics Co., Inc., South Deerfield, Mass. 01373.

Treated corrugated boards, Kraft paper and LDPE are available commercially from Rig Packaging Corporation, 145 Boxfield Road, Pittsburgh, Pa. 15241.

Such stretch-film wrapping and anchoring processes are carried out using power-driven mechanized equipment, as previously described in relation to FIGS. 1 and 2, for controlling film supply, tension in a direction of film length, and positioning of the film in relation to a coil (with vertically-oriented central axis) and its associated pallet. Such equipment is partially shown schematically in FIG. 10 in relation to coil 24. Stretch-film supply roll 110 is positioned with its roll axis substantially vertically-oriented in holding and tensioning means 38 which provides for selecting tension during unwinding of film 112 (free of any rotating movement of the coil and pallet). Wrapping arm 37 is supported and power-driven for rotation symmetrically of coil axis 26 for engagement of the film around the entire circumference of a coil being prepared, and contiguous to corners of a pallet. Vertical positioning means 43 functions to position the stretch-film supply roll at a vertical position, relative to the coil being packaged, as necessary for carrying out coil surface protection wraps and anchoring wraps of the invention.

Vertical positioning of such film supply roll and wrap sequencing can be preselected and programmed for the required height of each wrap, or portion of a wrap, as taught above. Means for widthwise gathering of such film is provided as part of the film source and tensioning means 38. Programming control 44, FIG. 1, provides vertical positioning necessary for the coil encapsulation process, as well as the anchoring process; such programming control can proceed from one wrap pattern phase to another, while maintaining film continuity and preselected automated control under operator observation.

Stretch-film wrapping, controlling the film supply and the circumscribing wrapping arm, with vertical positioning and tensioning control of the film source, provides preferred effectiveness and efficiency, free of any requirement for rotating a pallet and coil for wrapping purposes.

Specific processes, apparatus, materials, data, and ranges have been set forth for purposes of adequate disclosure of the invention. It should be recognized that, in the light of the above teachings, one skilled in the art will then be in a position to arrive at modifications or to substitute process steps, apparatus, physical values, materials, or the like, without departing from disclosed principles of the invention. Therefore, it is to be understood that, for purposes of determining the scope of the present invention, reference shall be made to the appended claims.

We claim:

1. Method for providing corrosion-protective packaging and for preventing handling and shipping damage to commercial-production tonnage quantities of flat-rolled sheet metal, comprising A. providing continuous-length flat-rolled sheet metal wound into a coil having a cylindrical-surface configuration as wound about a central axis, which is vertically-oriented, with sheet metal coil lap edges presenting a coil bottom-surface and a coil top-surface, with each of such surfaces being substantially horizontally-oriented;

B. providing a support pallet of selected dimensional and strength characteristics presenting (i) a substantially solid-surface load-bearing platform, free of an opening for securing a coil to such pallet, such platform having a substantially rectangular configuration, in plan view, for placement of such coil, and (ii) load bearing structural members for supporting such platform in a heightwise elevated position so as to allow for entry of means for lifting and supporting such pallet and load for transport thereof;

C. placing a component for bottom-surface protection of such coil on such pallet platform, with such coil being oriented with its central axis substantially vertically-oriented;

D. positioning such wound coil, with bottom surface substantially horizontally-oriented, centrally of such load bearing platform configuration with such bottom-surface protection component intermediate such coil bottom-surface and such load-bearing platform;

E. placing a top-surface protection component on the top-surface of such coil, which is horizontally-oriented, as such coil is positioned on such platform; and in which F. each of such bottom-surface and top-surface protection components includes a moisture-impervious protective sheet having a surface area significantly exceeding the surface area of its respective coil top or bottom-surface, so as to (i) extend each such protective sheet to cover its respective horizontally-oriented coil surface, and (ii) extend over its respective coil edge, to provide for encapsulation of each such respective surface;

G. placing moisture-impervious protective sheet around the cylindrical surface of such coil in contact with respective horizontally-oriented protective sheet on such coil;

H. selecting a vapor phase inhibitor for chemically preventing corrosion internally of a packaged coil and placement thereof within such moisture-impervious protective wrapping;

I. encapsulating such protectively-wrapped sheet metal coil with moisture-impervious protective wrapping by wrapping polymer stretch-film about the entire cylindrical surface of such coil, with such polymer stretch-film wrapping holding encapsulating top-surface and bottom-surface protective sheet component, extending over coil edge at each such respective horizontally-oriented coil surface, so as to substantially hermetically seal such coil and such top and bottom surface protective sheet components with such polymer film wrapping, in which such polymer stretch-film of selected tensile strength characteristics is provided in continuous-length form;

J. initiating integrally securing such encapsulated coil to such pallet by means of additional wrapping of such polymeric stretch-film in alternating contact with corner portions of such rectangular configuration platform and such coil periphery contiguous to such pallet platform, in a selected repetitive pattern, while maintaining such film under tension in the direction of its length; and K. gathering such polymer film widthwise, in transverse relationship to its length, for engagement in such gathered form with such coil and load-bearing structural members of such pallet, free of contact with corner portions of such pallet platform, so as to complete integrally securing such coil to such pallet platform and structural members.

2. The method of claim 1, wherein such polymer stretch-film is gathered widthwise, in transverse relationship to its length, in a continuous manner along its length, for use in completing securing such coil to such pallet platform and structural members.

3. The method of claim 1, wherein such polymer stretch-film comprises a low density polyethylene film with a thickness dimension of about six mils for hermetically encapsulating and securing such coil to such pallet platform and structural members.

4. The method of claim 1, including selecting components for such coil top, bottom and cylindrical surfaces to provide coil surface cushioning protection.

5. The method of claim 4, in which such vapor phase inhibitor is provided on horizontally-oriented coil confronting components so as to provide a concentration of about nine grams/square yard.

6. The method of claim 1, in which such flat-rolled sheet metal is selected from the group consisting of steel and aluminum;

such coil weight is selected in the range of about five to about twenty tons, and such coil diameter is selected in the range of about twenty inches to about sixty inches.

7. A packaging system for providing corrosion-protection and preventing handling damage to a commercial-tonnage coil formed from a plurality of flat-rolled sheet metal coil laps to have a cylindrical-configuration, comprising, in combination (A) pallet means of selected dimensional and structural strength characteristics for supporting such a sheet metal coil, with such pallet means presenting (i) a load-bearing platform of substantially rectangular configuration, in plan view, presenting a substantially planar upper support surface, and (ii) support structural members providing heightwise elevated support for such platform, so as to provide access openings for receiving elongated lift members, for transport of such pallet means and platform-supported coil;

(B) bottom-surface coil lap edge protection means for such a coil positioned on such load-bearing platform;

(C) a coil of commercial-tonnage, formed from a plurality of coil laps of flat-rolled sheet metal, to have a cylindrical-configuration, such coil having a vertically-oriented central axis which is perpendicularly transverse to such load-bearing platform, with such cylindrical coil positioned symmetrically with respect to such rectangular configuration platform and both top surface coil lap edges and bottom surface coil lap edges of such wound coil being horizontally-oriented;

(D) top-surface coil lap edge protection means of generically circular configuration for such horizontally-oriented coil top-surface with fluted periphery extending over such horizontally-oriented top-surface onto such cylindrical coil surface, with such top and bottom surface coil lap edge protection means confronting each such respective horizontally-oriented coil surface so as to seal such coil lap edges;

(E) polymeric film of selected width, tensile strength and stretch characteristics in continuous-length form, and (F) wrapping means for encapsulating such palletized cylindrical-configuration coil and securing such coil to such pallet means with such polymeric film, such wrapping means, including (i) a centrally-located rotational pivot support means aligned substantially vertically with such coil central axis, (ii) an elongated arm pivotally-connected at one of its longitudinal distal ends to such centrally-located rotational pivot support, (iii) drive means for revolving such elongated arm in circumscribing relationship to such coil to encapsulate such cylindrical surface of such coil bottom surface with polymer film, and to encapsulate such load-bearing pallet and a portion contiguous to its bottom surface, with polymeric film, (iv) spindle means for dispensing such polymeric film for wrapping such coil and securing it to such pallet, such spindle means being connected to such remaining distal longitudinal end of such elongated arm, (v) a vertically-oriented positioning rack for such spindle means, (vi) a power-driven source for rotating such spindle carrying such continuous-length polymeric film, (vii) means for controlling tensioning of such polymeric film as such spindle means is moved vertically and revolved about such cylindrical-configuration of such pallet-mounted coil, while such pallet-mounted coil remains stationary; and (viii) mechanical mounting means providing vertically-oriented movement of such power-driven spindle, and means for controlling tensioning of such film along such vertically-oriented positioning rack in parallel relationship to such coil central axis;

(G) selectively actuated means for gathering such polymeric film in a widthwise direction for use in securing such coil to such pallet by extending such gathered film vertically below paired comers of such rectangular configuration platform, and (H) programmable means for controlling such wrapping apparatus (i) to circumscribe such cylindrical-configuration coil, so as to wrap such cylindrical-configuration coil, and to wrap such fluted periphery of such top surface protection means extending onto such cylindrical-configuration, with such polymeric-film, so as to encapsulate such coil, and (ii) to secure such coil to such pallet load-bearing platform and to pallet structural members, by engaging corner edge portions of such load-bearing platform and such structural support members of such pallet with such gathered polymeric film.

* * * * *